US007586470B2

(12) United States Patent
Chen

(10) Patent No.: US 7,586,470 B2
(45) Date of Patent: Sep. 8, 2009

(54) OLED DEVICE CAPABLE OF ADJUSTING LUMINANCE

(75) Inventor: Chi-Chang Chen, Tao-Yuan (TW)

(73) Assignee: Princeton Technology Corporation, Hsin Tsien, Taipei County (TW)

( * ) Notice: Subject to any disclaimer, the term of this patent is extended or adjusted under 35 U.S.C. 154(b) by 544 days.

(21) Appl. No.: 11/563,023

(22) Filed: Nov. 23, 2006

(65) Prior Publication Data

US 2008/0001860 A1 Jan. 3, 2008

(30) Foreign Application Priority Data

Jun. 29, 2006 (TW) ..... 95123527 A

(51) Int. Cl.
*G09G 3/30* (2006.01)
*G09G 3/32* (2006.01)
*G09G 3/10* (2006.01)

(52) U.S. Cl. ..... 345/77; 345/82; 315/169.3

(58) Field of Classification Search ..... 345/77, 345/82; 315/169.3
See application file for complete search history.

(56) References Cited

U.S. PATENT DOCUMENTS

2003/0223275 A1* 12/2003 Abe ..... 365/189.09

* cited by examiner

*Primary Examiner*—Bipin Shalwala
*Assistant Examiner*—Ilana Spar
(74) *Attorney, Agent, or Firm*—Winston Hsu

(57) ABSTRACT

An OLED device includes a control voltage generator, a plurality of the first switches, a current mirror, a plurality of transistors, a control circuit, a second switch and an OLED equivalent module. The control voltage generator generates control voltage to the plurality of transistors while the control circuit generates switch signals to the plurality of the first switches, and the plurality of transistors generates current to the current mirror according to the plurality of the first switches and the control voltage. The current mirror duplicates the received current to the OLED equivalent module. The second switch controls switching on and off the OLED equivalent module. If the second switch is turned on, the OLED equivalent module emits light according to the received current.

6 Claims, 3 Drawing Sheets

OLED DEVICE CAPABLE OF ADJUSTING LUMINANCE

BACKGROUND OF THE INVENTION

1. Field of the Invention

The present invention relates to an organic light emitting diode (OLED) device, and more particularly to an OLED device capable of adjusting luminance.

2. Description of the Prior Art

Please refer to FIG. 1. FIG. 1 illustrates a circuit diagram of controlling a conventional OLED 100. As illustrated in FIG. 1, the conventional OLED device 100 includes a reference current source $I_{REF}$, two transistors Q1 and Q2, an OLED equivalent module 110, a bias source VH, and a variable resistor VR1. The OLED equivalent module 110 includes an OLED D1, an equivalent capacitor C1, two resistors R1 and R2. Luminance of the OLED D1 is determined by current that flows through identity, therefore in order to change the luminance of the OLED D1, the current that flows through identity has to be changed. As illustrated in FIG. 1, the transistors Q1 and Q2 is connected as a current mirror, which duplicates the reference current $I_{REF}$ to the transistor Q2 such that the current outputted by the transistor Q2 is the same as $I_{REF}$. The current $I_{REF}$ outputted by the transistor Q2 is split into two currents $I_1$ and $I_2$ after passing through parallel circuits formed by the OLED equivalent module 110 and the variable resistor VR1, thus the current that flowed through the OLED equivalent module 110 is $I_1$, as the addition of currents $I_1$ and $I_2$ equals to the current $I_{REF}$, then the value of the current $I_1$ can be changed by changing the value of the current $I_2$. Therefore, a resistance value of the variable resistor VR1 can be utilized to change the value of the current $I_2$, in doing so the value of the current $I_1$ passing through the OLED equivalent module 110 is also changed; hence the objective of changing the luminance of the OLED equivalent module 110 is reached.

But there are a few problems in the above-mentioned prior art in controlling the luminance of the OLED device. First, in the manufacturing process, it is not easy to fit the whole devices of the above-mentioned into a same chip as the variable resistor takes up a significant surface area. Hence this method is not suitable or compliant for the current trend of producing smaller chipsets. Second, if the variable resistor is further coupled to the external portion of the OLED in a discrete manner, the resistance value of the variable resistor may shift and fix at a predetermined value difficulty. Lastly, during manufacturing, each variable resistor that controls the OLED device needs to be adjusted so that the luminance of the OLED can be uniform, thus this method is unable to effectively control the OLED.

SUMMARY OF THE INVENTION

The claimed invention discloses an organic light emitting diode (OLED) device capable of adjusting luminance. The OLED device comprises: a control voltage generator, a plurality of transistors, a control circuit, a second switch, and an OLED equivalent module. The control voltage generator comprises a reference current source for providing a reference current, and a first transistor comprising a first end coupled to the reference current source, a second end coupled to a first voltage source, and a control end. The control voltage generator is utilized for generating a control voltage according the reference current at the control end of the first transistor. A first end of each first switch of the plurality of first switches is coupled to the control end of the first transistor. The current mirror comprises a first end and a second end. Each second transistor of the plurality of second transistors comprises a first end coupled to the first end of the current mirror, a second end coupled to the first voltage source, and a control end coupled to a second end corresponding to the first switch of the plurality of first switches. The control circuit coupled to the plurality of first switches is used for controlling switching on and off the plurality of the first switches. The second switch comprises a first end coupled to the first voltage source, and a second end. The first OLED module is coupled between the second end of the current mirror and the second end of the second switch for generating light.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, consumer electronic equipment manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
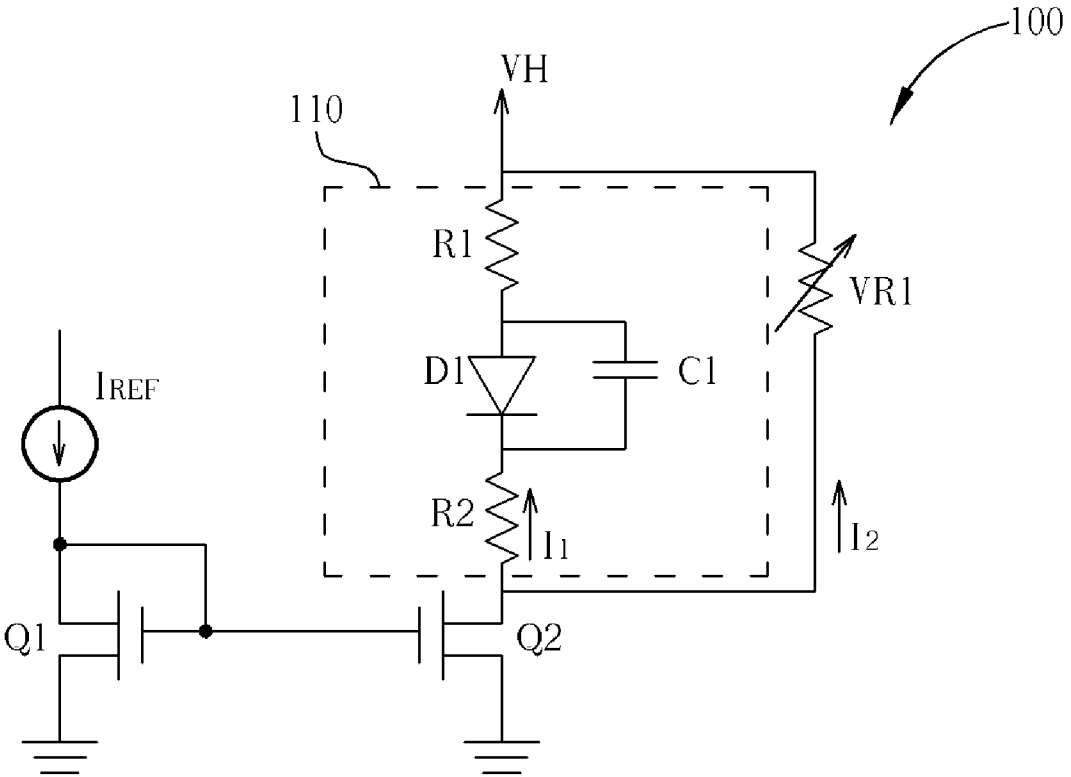
Fig. 1 Prior art
FIG. 1 illustrates a circuit diagram of controlling a conventional organic light emitting diode (OLED).
Figure 2:
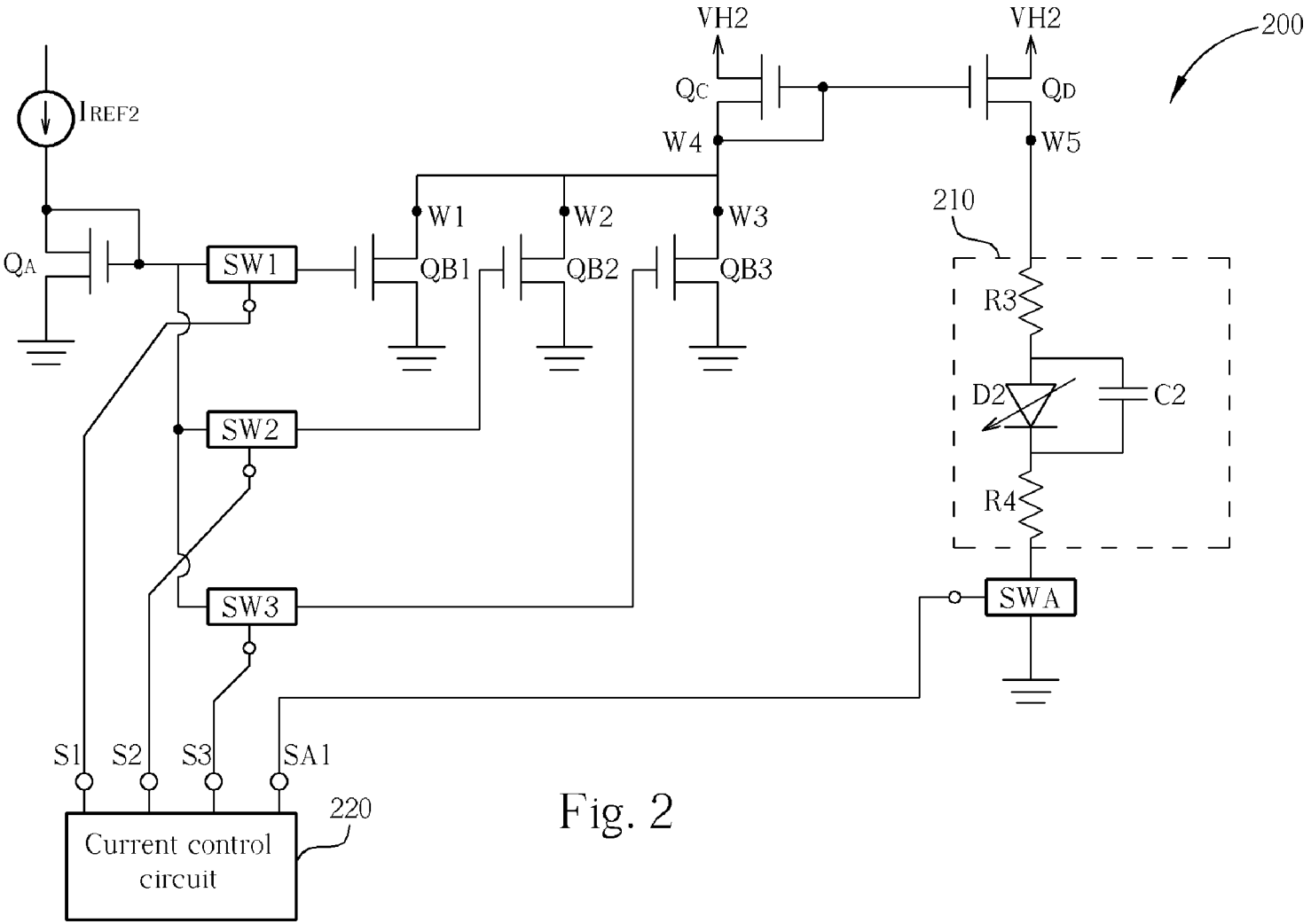
FIG. 2 illustrates a circuit diagram of adjusting luminance of an OLED device according to the present invention.

Please refer to FIG. 2. FIG. 2 illustrates a circuit diagram of adjusting luminance of an organic light emitting diode (OLED) device 200 according to the present invention. As illustrated in FIG. 2, the luminance adjustable OLED device 200 includes a reference current source $I_{REF2}$, four switches SW1, SW2, SW3, and SWA, six transistors QA, QB1, QB2, QB3, QC and QD, a current control circuit 220(current circuit), an OLED equivalent module 210, a bias source VH2, and five nodes W1, W2, W3, W4, and W5. The OLED equivalent module 210 includes two equivalent resistors R3 and R4, an OLED D2, and an equivalent capacitor C2. The current control circuit 220 controls four switch signals S1, S2, S3, and SA1 which are respectively utilized for controlling turning on or off of the switches SW1, SW2, SW3, and SWA. The operational theory will be explained in FIG. 2.

As illustrated in FIG. 2, the transistor QA is utilized for receiving a reference current $I_{REF2}$ and for providing gate signals to the transistors QB1, QB2, and QB3. Each pair of the transistors QA and QB1, the transistors QA and QB2, and the transistor QA and QB3 respectively forms a current mirror pair. For example, when the switch SW1 is turned on, the transistor QB1 is turned on and a reference current $I_{REF2}$ identical to the value of the reference current of the transistor QA is generated at the node W1. Similarly, when the switch SW2 is turned on, the transistor QB2 is turned on and the current $I_{REF2}$ is generated at the node W2, and when the switch SW3 is turned on, the transistor QB3 is turned on and the current $I_{REF2}$ is generated at the node W3. The amount of current flowing through the node W4 is the total of currents at the nodes W1, W2, and W3. If the transistors QB1, QB2 and QB3 are turned on, then $I_{REF2}$ will be respectively generated at the nodes W1, W2 and W3, and the current at the node W4 is three times the value of $I_{REF2}$ ($I_{REF2}$+$I_{REF2}$+$I_{REF2}$). If one of the transistors within the transistors QB1, QB2 and QB3 is turned off, and at the same time the other 2 transistors are turned on, then the current at the node W4 will be twice the value of $I_{REF2}$ ($I_{REF2}$+$I_{REF2}$), and so forth. Therefore the value of the current at the node W4 can be adjusted to for example, 0, $1_{REF2}$, twice $I_{REF2}$ and 3 times $I_{REF2}$, by controlling the turning on or off of the transistors QB1, QB2 and QB3. And the switch signals S1, S2 and S3 that controls the transistors QB1, QB2 and QB3 are transmitted from the current control circuit 220. In this way, the current control circuit 220 can be solely operated to control the value of the current at the node W4. And the transistors QC and QD also form a current mirror pair, thus the value of the current flowing through the mode W4 is also duplicated to the node W5 of the transistor QD. If the current flowing through the node W4 is twice $I_{REF2}$, then the current at the node W5 is the same as twice $I_{REF2}$, therefore by controlling the value of the current flowing through the node W4, the value of the current flowing through the node W5 can also be controlled. Please refer to FIG. 2, the OLED equivalent module 210 is coupled to the node W5, thus current flowing through the OLED equivalent module 210 is also identical to the value of the current flowing through the node W4. Therefore the current flowing through the nodes W1, W2, and W3 can be controlled through the current control circuit 220, so that the current flowing through the node W4 can be further controlled, and that the current flowing through the OLED equivalent module 210 can also be controlled. Also in the characteristics of the OLED, the luminance generated directly corresponds to the current flowing through the OLED, therefore the luminance of the OLED equivalent module 210 can be controlled by controlling the current control circuit 220.

In the above-mentioned, the current control circuit 220 can control the luminance of the OLED equivalent module 210, and the current control circuit 220 further controls a switch SWA. The switch SWA is utilized for controlling the OLED equivalent module 210 to emit light or not. If the switch SWA is turned on, then the OLED equivalent module 210 emits light according to the value of the current that flows through it. If the switch SWA is turned off, then the OLED equivalent module 210 does not emit light. This is an additional function of the current control circuit 220.

Although there are only three transistors in the series of transistors QB as illustrated in FIG. 2, the number of transistors can be expanded to N, the corresponding number of switch can also be increased to SWN, and the switch signals controlled by the current control circuit 220 can also be increased to SN for providing more current value selections for the OLED equivalent module 210 such as from 0, $I_{REF2}$, 2 times $I_{REF2}$, 3 times $I_{REF2}$, 4 times $I_{REF2}$ to N times $I_{REF2}$, such that it is more flexibility for the present invention to control the OLED equivalent module 210.

Figure 3:
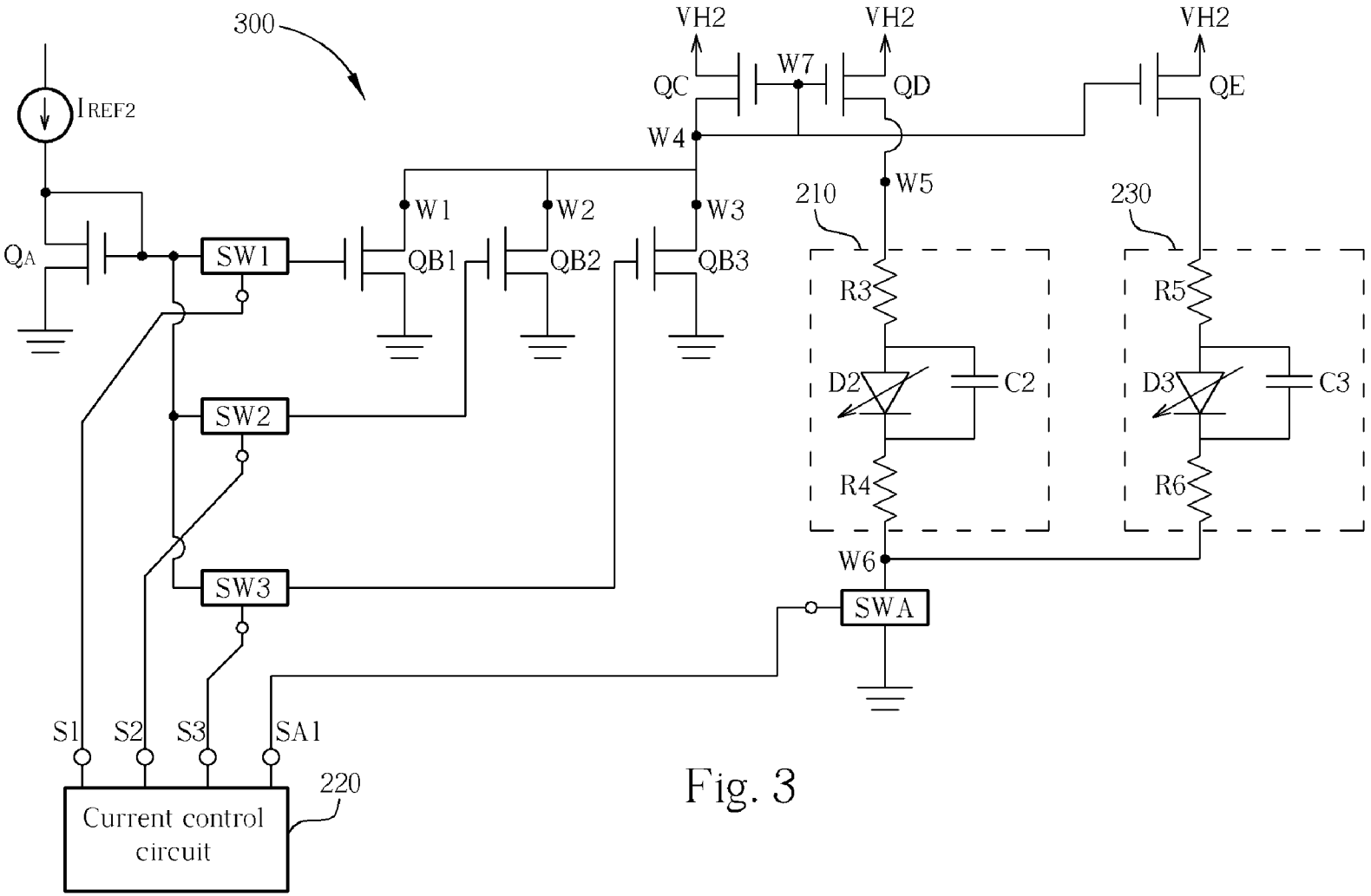
FIG. 3 illustrates a circuit diagram of adjusting luminance of an OLED device according to another embodiment of the present invention.

Please refer to FIG. 3. FIG. 3 illustrates a circuit diagram of adjusting luminance of an OLED device 300 according to another embodiment of the present invention. The difference with FIG. 2 is that FIG. 3 further includes a set of transistor QE and an OLED equivalent module 230. A gate of the transistor QE is coupled to a node W7, and an end of the OLED equivalent module 230 is coupled to the transistor QE, and another end of the OLED equivalent module 230 is coupled to the node W6. Similarly, luminance of the OLED equivalent module 230 can also be controlled through the current control circuit 220, and the OLED equivalent module 230 can stop emitting light by turning off the switch SWA.

Although there are only two sets of OLED equivalent modules 210, 230 represented in FIG. 3, the present invention can still expand to more OLED equivalent modules such as 3, 4 or N, which is limited by the metes and bounds of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An organic light emitting diode (OLED) device capable of adjusting luminance, the OLED device comprising:

a control voltage generator comprising:

a reference current source for providing a reference current; and a first transistor comprising:

a first end coupled to the reference current source;

a second end coupled to a first voltage source; and a control end, the control voltage generator being utilized for generating a control voltage according the reference current at the control end of the first transistor;

a plurality of first switches, a first end of each first switch coupled to the control end of the first transistor;

a current mirror comprising a first end and a second end;

a plurality of second transistors, each second transistor comprising:

a first end coupled to the first end of the current mirror;

a second end coupled to the first voltage source; and a control end coupled to a second end corresponding to a first switch of the plurality of first switches;

a control circuit coupled to the plurality of first switches for controlling turning on and off the plurality of the first switches respectively;

a second switch comprising:

a first end coupled to the first voltage source; and a second end; and a first OLED module coupled between the second end of the current mirror and the second end of the second switch for generating light.

2. The OLED device of claim 1 wherein the first OLED module comprises:

a first resistor coupled to the second end of the current mirror;

a second resistor coupled to the second end of the second switch;

a first OLED comprising a positive end coupled to the first resistor and a negative end coupled to the second resistor, for generating light according to currents transmitted from the second end of the current mirror; and a first equivalent capacitor coupled between the first resistor and the second resistor.

3. The OLED device of claim 1 wherein the current mirror comprises:

a third transistor comprising:

a first end coupled to the first end of the current mirror;

a second end coupled to the second end of the current mirror; and a third end;

a fourth transistor comprising:

a first end coupled to the second end of the current mirror;

a second end coupled to the first end of the current mirror; and a third end; and a bias circuit coupled to the third end of the third transistor and the third end of the fourth transistor for biasing the third transistor and the fourth transistor.

4. The OLED device of claim 3 wherein the current mirror further comprises:

a fifth transistor comprising:

a first end coupled to the third end of the current mirror;

a second end coupled to the first end of the current mirror; and a third end coupled to the bias circuit for receiving bias provided by the bias circuit.

5. The OLED device of claim 4 further comprising a second OLED module coupled between the first end of the fifth transistor and the second end of the second switch for generating light.

6. The OLED device of claim 5 wherein the second OLED module comprises:

a third resistor coupled to the first end of the fifth transistor;

a fourth resistor coupled to the second end of the second switch;

a second OLED comprising a positive end coupled to the third resistor and a negative end coupled to the fourth resistor, for generating light according to currents transmitted from the first end of the fifth transistor; and a second equivalent capacitor coupled between the third resistor and the fourth resistor.

* * * * *

UNITED STATES PATENT AND TRADEMARK OFFICE

CERTIFICATE OF CORRECTION

PATENT NO. : 7,586,470 B2
APPLICATION NO. : 11/563023
DATED : September 8, 2009
INVENTOR(S) : Chi-Chang Chen It is certified that error appears in the above-identified patent and that said Letters Patent is hereby corrected as shown below:

On the title page, item (73), correct the residence of the assignee from "Hsin Tsien" to "Hsin Tien".

Signed and Sealed this

Third Day of November, 2009

David J. Kappos

David J. Kappos
*Director of the United States Patent and Trademark Office*